US009365008B1

(12) United States Patent
Walker

(10) Patent No.: US 9,365,008 B1
(45) Date of Patent: Jun. 14, 2016

(54) ACTUATING DEVICE

(71) Applicant: Michael Kenneth Walker, Seal Beach, CA (US)

(72) Inventor: Michael Kenneth Walker, Seal Beach, CA (US)

( * ) Notice: Subject to any disclaimer, the term of this patent is extended or adjusted under 35 U.S.C. 154(b) by 526 days.

(21) Appl. No.: 13/631,281

(22) Filed: Sep. 28, 2012

(51) Int. Cl.
*B30B 1/26* (2006.01)

(52) U.S. Cl.
CPC ..... *B30B 1/261* (2013.01)

(58) Field of Classification Search
CPC ..... B30B 1/261
USPC ..... 74/99 R; 72/401, 402; 425/78, 125, 398, 425/412, 414, 416, 444; 100/269.01, 100/269.05, 269.18
See application file for complete search history.

(56) References Cited

U.S. PATENT DOCUMENTS

| | | | | | |
|---|---|---|---|---|---|
| 279,118 | A | * | 6/1883 | Allen | 72/401 |
| 353,929 | A | * | 12/1886 | Gerald | 72/354.2 |
| 1,047,375 | A | * | 12/1912 | Brune | 72/401 |
| 1,539,800 | A | * | 5/1925 | Brainard | 72/401 |
| 1,617,906 | A | * | 2/1927 | Holt | 72/362 |
| 2,006,283 | A | * | 6/1935 | Staempfli | 72/401 |
| 2,313,749 | A | * | 3/1943 | Hothersall | 72/378 |
| 2,659,407 | A | * | 11/1953 | Gilchrist | 72/401 |
| 2,947,081 | A | * | 8/1960 | Clevenger | 72/276 |
| 3,064,710 | A | * | 11/1962 | Willis | 72/57 |
| 3,094,887 | A | * | 6/1963 | Zwald | 72/401 |
| 3,177,688 | A | * | 4/1965 | Kralowetz | 72/21.5 |
| 3,200,424 | A | * | 8/1965 | McClellan et al. | 470/28 |
| 3,263,474 | A | * | 8/1966 | Pentland | 72/370.04 |
| 3,530,717 | A | * | 9/1970 | Gregg | 72/401 |
| 3,531,971 | A | * | 10/1970 | Robb et al. | 72/385 |
| 3,681,966 | A | * | 8/1972 | Kralowetz et al. | 72/402 |
| 3,736,788 | A | * | 6/1973 | Olive-Jones et al. | 72/402 |
| 3,742,754 | A | * | 7/1973 | Jeromson et al. | 72/402 |
| 3,834,212 | A | * | 9/1974 | Roper | 72/354.2 |
| 3,851,514 | A | * | 12/1974 | Chen et al. | 72/402 |
| 3,855,837 | A | * | 12/1974 | Philipp | 72/401 |
| 4,118,970 | A | * | 10/1978 | Patel | 72/402 |
| 4,236,295 | A | * | 12/1980 | Nakamura | 29/598 |
| 4,244,091 | A | * | 1/1981 | Kimble et al. | 29/237 |
| 4,250,733 | A | * | 2/1981 | Ruhl et al. | 29/243.529 |
| 4,252,011 | A | * | 2/1981 | MacNitt et al. | 72/354.2 |
| 4,428,220 | A | * | 1/1984 | Rammesten | 72/370.05 |
| 4,505,144 | A | * | 3/1985 | Sakuma et al. | 72/345 |
| 4,781,055 | A | * | 11/1988 | Phipps | 72/402 |
| 4,831,864 | A | * | 5/1989 | Schmoll et al. | 72/402 |
| 5,313,816 | A | * | 5/1994 | Schubert et al. | 72/402 |
| 5,467,707 | A | * | 11/1995 | Kanamaru | 100/292 |
| 5,655,402 | A | * | 8/1997 | Schubert | 72/402 |
| 5,836,197 | A | * | 11/1998 | McKee et al. | 72/402 |
| 5,960,529 | A | * | 10/1999 | Haesemann et al. | 29/516 |
| 6,178,802 | B1 | * | 1/2001 | Reynolds | 72/402 |
| 6,192,733 | B1 | * | 2/2001 | Long et al. | 72/430 |
| 6,401,516 | B1 | * | 6/2002 | Herndl et al. | 72/453.18 |
| 6,510,722 | B1 | * | 1/2003 | Ching et al. | 72/402 |

(Continued)

*Primary Examiner* — William Kelleher
*Assistant Examiner* — Gregory Prather
(74) *Attorney, Agent, or Firm* — Edward P. Dutkiewicz

(57) ABSTRACT

An actuating device comprising, in combination, a actuating body. There is an internal guide configured to be slidably received within the actuating body. The internal guide has a centrally located central push rod hole. There is a central push rod assembly located within the central push rod hole of the internal guide. There is a beveled slide collar within the interior surface of the actuating body, and the beveled slide collar contains a beveled slide. The beveled slide as having four like-configured components. There is at least one push rod contained within the internal guide.

12 Claims, 8 Drawing Sheets

(56) References Cited

U.S. PATENT DOCUMENTS 7,007,537 B1 * 3/2006 Brown et al. ..... 72/357
7,028,524 B1 * 4/2006 Brown et al. ..... 72/361
2009/0044883 A1 * 2/2009 Prasser et al. ..... 148/593
2012/0086151 A1 * 4/2012 Walker et al. ..... 264/313

* cited by examiner

FIG. 3
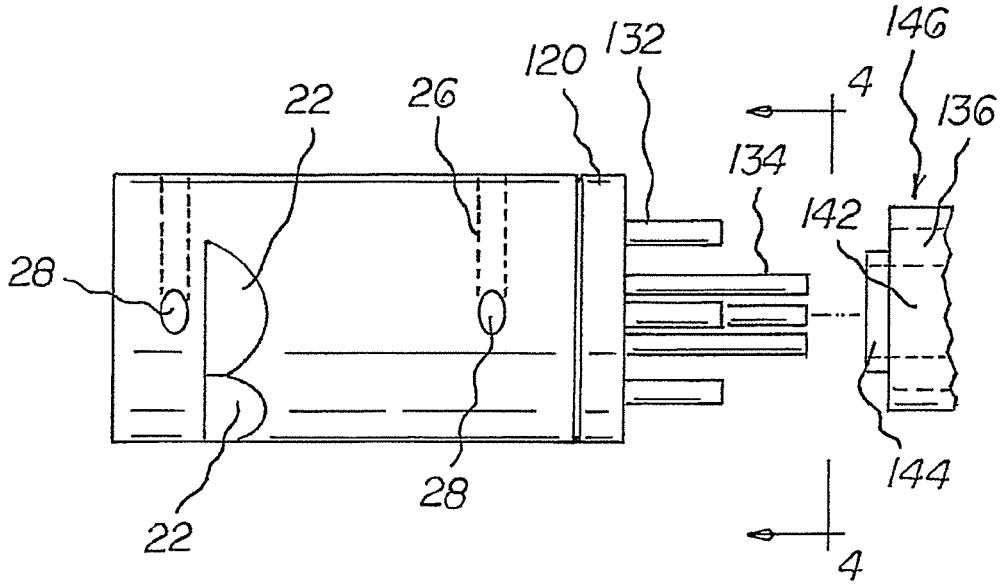
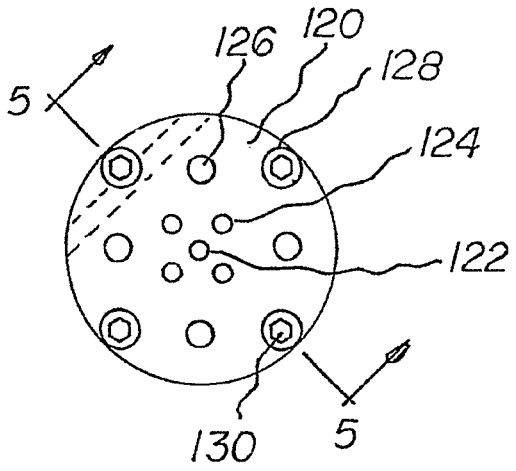
FIG. 4

FIG. 7
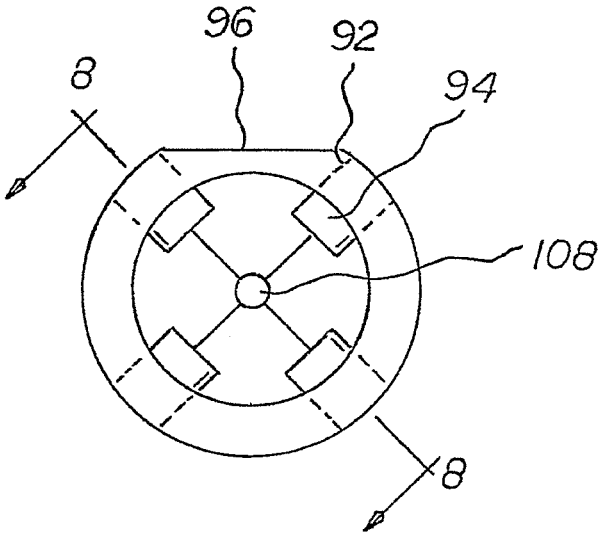
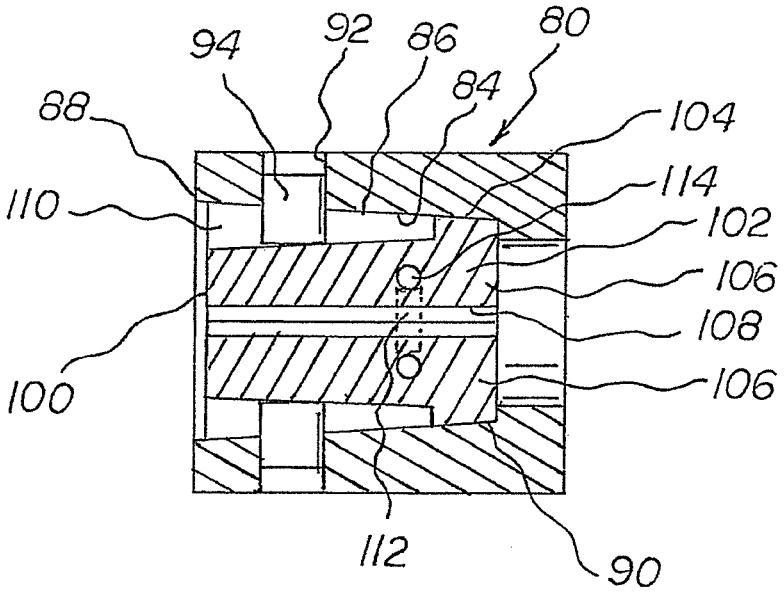
FIG. 8

ACTUATING DEVICE

RULE 1.78(F)(1) DISCLOSURE

The Applicant has not submitted a related pending or patented non-provisional application within two months of the filing date of this present application. The invention is made by a single inventor, so there are no other inventors to be disclosed. This application is not presently under assignment to any other person or entity at this time.

BACKGROUND OF THE INVENTION

1. Field of the Invention

The present invention relates to a Actuating Device and more particularly pertains to a device for effectuating a moulding process.

2. Description of the Prior Art

The use of moulding devices is known in the prior art. More specifically, moulding devices previously devised and utilized for the purpose of shaping objects are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art does not describe an actuating device that allows a user to efficiently effectuate a molding process.

In this respect, the actuating device according to the present invention substantially departs from the conventional concepts and designs of the prior art, and in doing so provides an apparatus primarily developed for the purpose of a device for effectuating a molding process.

Therefore, it can be appreciated that there exists a continuing need for a new and improved actuating device which can be used for effectuating a molding process. In this regard, the present invention substantially fulfills this need.

SUMMARY OF THE INVENTION

In view of the foregoing disadvantages inherent in the known types of moulding devices now present in the prior art, the present invention provides an improved actuating device. As such, the general purpose of the present invention, which will be described subsequently in greater detail, is to provide a new and improved actuating device which has all the advantages of the prior art and none of the disadvantages.

To attain this, the present invention essentially comprises an actuating device comprising several components, in combination.

There is a actuating body. The actuating body is fabricated of a rigid material. A rigid material refers to a metal or composite, such as, but not limited to, aluminum, stainless steel, steel, iron, titanium, and carbon fiber.

The actuating body has a proximal end and a distal end. The actuating body has a generally round tubular configuration, with an exterior surface, an interior surface, and a width there between. The exterior surface has a pair of wedge shaped recesses located adjacent the distal end, and an inlet recess located on the distal end. Adjacent is taken to mean that the wedge shaped recesses are near the distal end, whereas the inlet recess is on the distal end.

The actuating body has a pair of locking pin holes therethrough, with each locking pin hole having an associated locking pin. The actuating body has three threaded assembly screw holes in the distal end. The locking pin holes pass through the actuating body in a secant orientation. Secant orientation means that the locking pin holes are not both located on a line which passes through the center of the actuating body.

There is an internal guide. The internal guide is fabricated of a rigid material, as previously described. The internal guide is configured to be slidably received within the interior surface of the actuating body. The internal guide has a proximal end and a distal end. The internal guide has a generally round solid configuration with an external surface. The internal guide has four external push rod holes, four internal push rod holes, and a centrally located central push rod hole.

The four external push rod holes are annularly located, running from the proximal end of the internal guide to the distal end of the internal guide. The four external push rod holes are located a first distance from the central push rod hole. The four external push rod holes each have a first internal diameter.

The four internal push rod holes are annularly located running from the proximal end of the internal guide to the distal end of the internal guide. The four internal push rod holes are located a second distance from the central push rod hole. The first distance being greater than the second distance. The four internal push rod holes each have a second internal diameter. The first internal diameter is greater than the second internal diameter.

The internal guide central push rod hole has a third internal diameter. The third internal diameter is greater than the first internal diameter.

There is a central push rod assembly located within the central push rod hole of the internal guide. The central push rod assembly comprises a distal central push rod and a proximal central push rod. The distal central push rod and the proximal central push rod each have a fourth external diameter.

The distal central push rod has a round solid straight shaft configuration with a proximal end and a distal end. The distal central push rod has a stop flange. The stop flange is located adjacent the proximal end of the distal central push rod. The stop flange has a fifth external diameter, with the fifth external diameter being greater than the fourth external diameter of the proximal central push rod.

The proximal central push rod comprises a round solid straight shaft configuration with a proximal end and a distal end.

The proximal central push rod has a distal sleeve and a proximal sleeve. The proximal sleeve has a round tubular configuration. The proximal sleeve has a first length, with a push rod hole there through. The proximal sleeve push rod hole is sized to be greater than the fourth external diameter, less than the fifth external diameter, and sized to slideably receive the proximal central push rod within the proximal sleeve push rod hole.

The distal proximal central push rod sleeve has a round tubular configuration with a second length with a push rod hole therethrough. The distal sleeve push rod hole has a stepped internal diameter, with the push rod hole of the proximal end of the distal sleeve being sized to slidably receive the fourth external diameter of the proximal push rod, and the push rod hole of the distal end of the distal sleeve being sized to slidably receive the fifth external diameter of the end flange of the distal end of the proximal central push rod.

The push rod hole of the distal end of the distal sleeve is greater than the push rod hole of the proximal end of the distal sleeve, thereby restricting the travel of the proximal push rod within the push rod hole of the distal sleeve. The second sleeve length is greater than the first sleeve length.

The distal push rod has a guide sleeve. The guide sleeve has a round tubular configuration with a first length, with a push rod hole therethrough.

There is a beveled slide collar. The beveled slide collar is fabricated of a rigid material. The beveled slide collar has an exterior surface and an interior surface, with a thickness therebetween. The beveled slide collar has a tapered central aperture therethrough, with the tapered central aperture having a proximal end and a distal end. The proximal end aperture is larger then the distal end aperture, with a continuous narrowing of the aperture therebetween. The beveled slide collar has four locking lug holes running radially from the exterior surface to the interior surface. The beveled slide collar has four locking lugs with one of the locking lugs being associated with one of the locking lug holes. The locking lugs each have a solid tubular shaft configuration. The proximal end of the beveled slide collar has a recess therein.

There is a beveled slide. The beveled slide has four like-configured components. Each component of the beveled slide has a tapered exterior surface and a perpendicular biplanar interior surface, with a central recess therein. Each beveled slide component exterior surface has a V-shaped tapered recess therein. Each component has a pair of intersecting pin holes running radially from the exterior surface to the interior surface. Each of the intersecting holes has an associated pin.

There is a push rod guide. The push rod guide has a round solid disc-like configuration with a central push rod hole, four internal push rod holes, four external push rod holes, and four recessed bolt holed therein. The central push rod hole is sized to slidably receive the central push rod. The four internal push rod holes are sized to slidably receive each of the four internal push rods. The four external push rod holes are sized to slideably receive each of the four external push rods. The push rod guide has three associated threaded screws, with the screws being configured to be threadedly received and be mated with each of the threaded assembly screw holes of the actuating body.

There are four external push rods. Each external push rod has a straight solid rod configuration. Each external push rod is sized to be slidably received within the external push rod holes of the internal guide.

There are four internal push rods. Each internal push rod has a straight solid rod configuration. Each internal push rod is sized to be slidably received within the internal push rod holes of the internal guide.

There is an internal distal collar slide. The internal distal collar slide has a round shaft configuration, with a proximal end and a distal end. The internal distal slide collar has a central aperture therethrough. The central aperture of the internal distal collar slide runs from the proximal end to the distal end. The internal distal slide collar proximal end has a protrusion.

Lastly, there is an internal distal collar slide body. The internal distal collar slide body has a round shaft configuration, with a proximal end and a distal end. The internal distal slide collar body has a central aperture therethrough. The central aperture of the internal distal collar slide body is sized to slidably receive the internal distal collar slide there within.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved actuating device which has all of the advantages of the prior art moulding devices and none of the disadvantages.

It is another object of the present invention to provide a new and improved actuating device which may be easily and efficiently manufactured and marketed.

It is further object of the present invention to provide a new and improved actuating device which is of durable and reliable constructions.

An even further object of the present invention is to provide a new and improved actuating device which is susceptible of a low cost of manufacture with regard to both materials and labor, and which accordingly is then susceptible of low prices of sale to the consuming public, thereby making such actuating device economically available to the buying public.

Even still another object of the present invention is to provide an actuating device for efficiently effectuating a molding process.

Lastly, it is an object of the present invention to provide a new and improved actuating device comprising, in combination, a actuating body. There is an internal guide configured to be slidably received within the actuating body. The internal guide has a centrally located central push rod hole. There is a central push rod assembly located within the central push rod hole of the internal guide. There is a beveled slide collar within the interior surface of the actuating body, and the beveled slide collar contains a beveled slide. The beveled slide as having four like-configured components. There is at least one push rod contained within the internal guide.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a view taken along line 3-3 of FIG. 2.

FIG. 4 is a view taken along line 4-4 of FIG. 3.

FIG. 7 is a view taken along line 7-7 of FIG. 6.

FIG. 8 is a view taken along line 8-8 of FIG. 7. FIG. 8 shows the closed orientation of the segmented die.

The same reference numerals refer to the same parts throughout the various Figures.

DESCRIPTION OF THE PREFERRED EMBODIMENT

Figure 1:
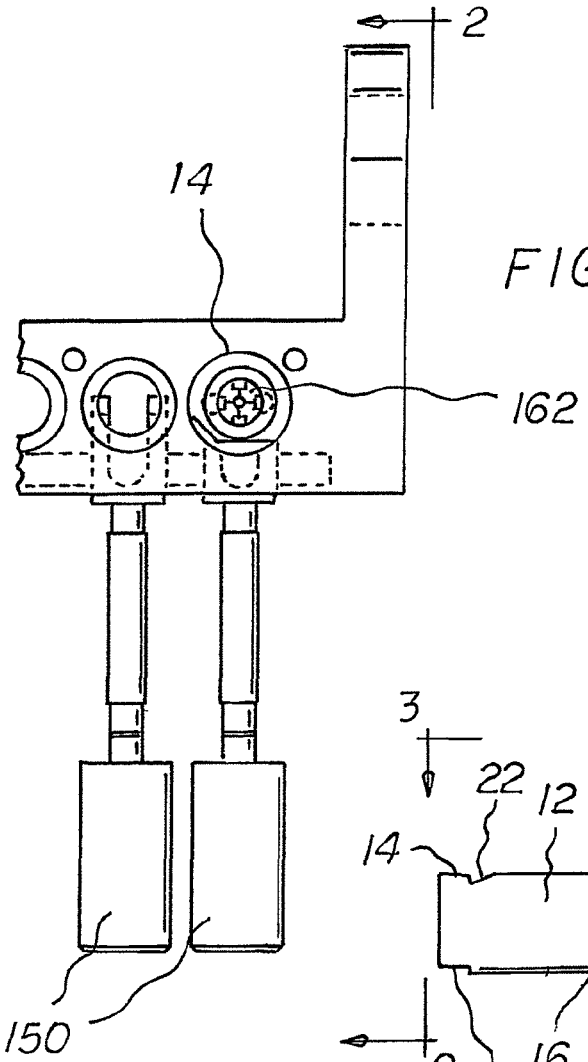
FIG. 1 is proximal elevational view of the device in place with a nitrogen spring.
Figure 2:
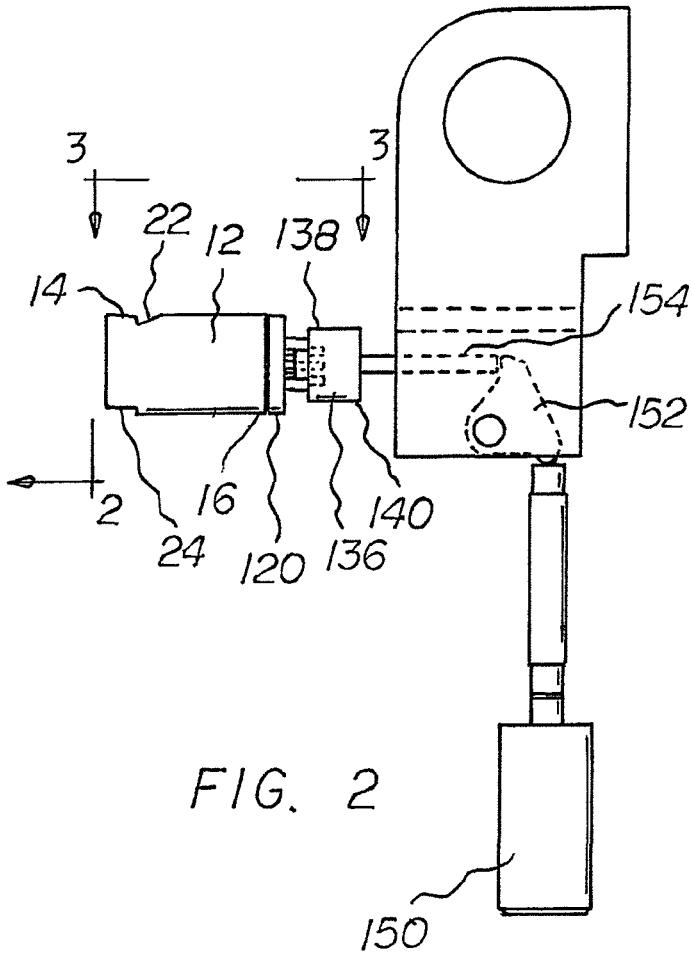
FIG. 2 is a view taken along line 2-2 of FIG. 1.
Figure 5:
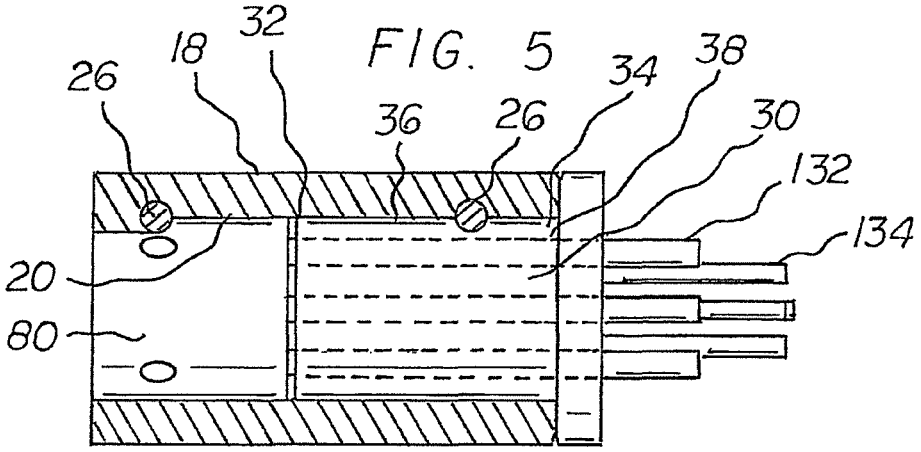
FIG. 5 is a view taken along line 5-5 of FIG. 4.
Figure 6:
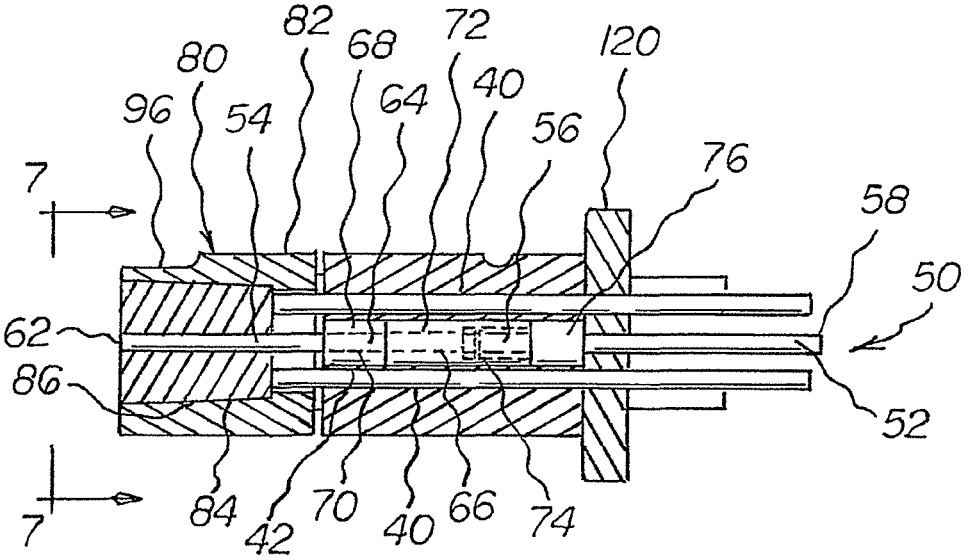
FIG. 6 is a cross sectional view of the actuating device.
Figure 9:
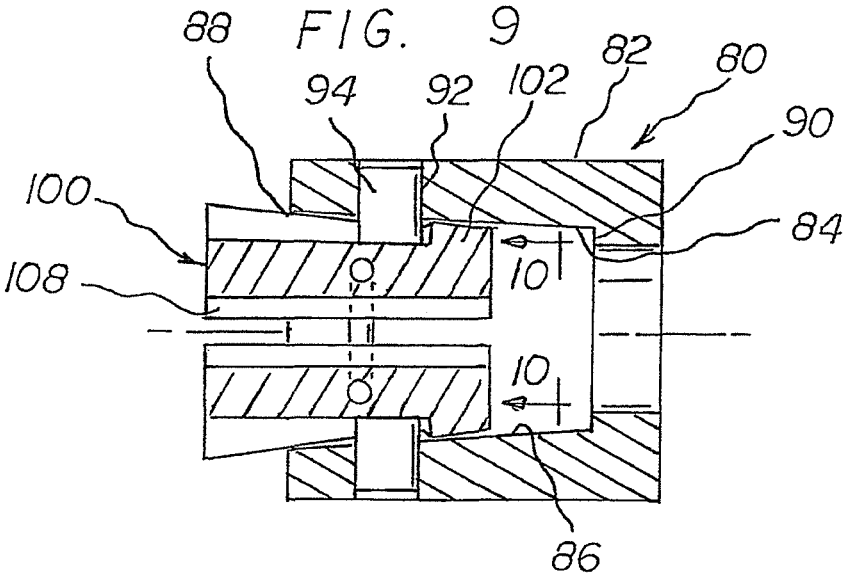
FIG. 9 is a cross sectional view of the segmented die, showing the die in the open orientation.

With reference now to the drawings, and in particular to FIG. 1 thereof, the preferred embodiment of the new and improved Actuating Device embodying the principles and concepts of the present invention and generally designated by the reference numeral 10 will be described.

The present invention, the Actuating Device 10 is comprised of a plurality of components. Such components in their broadest context include an actuating body, an internal guide, a slide collar and a segmented die. Such components are individually configured and correlated with respect to each other so as to attain the desired objective.

An actuating device 10 comprising several components, in combination, is herein described.

There is a actuating body 12. The actuating body is fabricated of a rigid material. A rigid material refers to a metal or composite, such as, but not limited to, aluminum, stainless steel, steel, iron, titanium, and carbon fiber. Rigidity refers to a quality of a material which has no substantial flex or give.

The actuating body has a proximal end 14 and a distal end 16. The actuating body has a generally round tubular configuration, with an exterior surface 18, an interior surface 20, and a width there between. The exterior surface has a pair of wedge shaped recesses 22 located adjacent the proximal end, and an inlet recess 24 located on the proximal end. Adjacent is taken to mean that the wedge shaped recesses are near the proximal end, whereas the inlet recess is on the proximal end.

The actuating body has a pair of locking pin holes 26 therethrough, with each locking pin hole having an associated locking pin 28. The actuating body has three threaded assembly screw holes (not shown, but well known in the art) in the distal end.

The locking pin holes pass through the actuating body in a secant orientation. Secant orientation means that the locking pin holes are not both located on a line which passes through the center of the actuating body.

There is an internal guide 30. The internal guide is fabricated of a rigid material. The internal guide is configured to be slidably received within the interior surface of the actuating body. The internal guide has a proximal end 32 and a distal end 34. The internal guide has a generally round solid configuration with an external surface 36. The internal guide has four external push rod holes 38, four internal push rod holes 40, and a centrally located central push rod hole 42.

The four external push rod holes are annularly located, running from the proximal end of the internal guide to the distal end of the internal guide. The four external push rod holes are located a first distance from the central push rod hole. The four external push rod holes each have a first internal diameter.

The four internal push rod holes are annularly located running from the proximal end of the internal guide to the distal end of the internal guide. The four internal push rod holes are located a second distance from the central push rod hole. The first distance being greater than the second distance. The four internal push rod holes each have a second internal diameter. The first internal diameter is greater than the second internal diameter.

The internal guide central push rod hole has a third internal diameter. The third internal diameter is greater than the first internal diameter.

There is a central push rod assembly 50 located within the central push rod hole of the internal guide. The central push rod assembly comprises a distal central push rod 52 and a proximal central push rod 54. The distal central push rod and the proximal central push rod each have a fourth external diameter.

The distal central push rod has a round solid straight shaft configuration with a proximal end 56 and a distal end 58. The distal central push rod has a stop flange 60. The stop flange is located adjacent the proximal end of the distal central push rod. The stop flange is sized to be slidably received within the third internal diameter of the internal guide central push rod hole.

The stop flange has a fifth external diameter, with the fifth external diameter being greater than the fourth external diameter of the proximal central push rod.

The proximal central push rod comprises a round solid straight shaft configuration with a proximal end 62 and a distal end 64.

The proximal central push rod has a distal sleeve 66 and a proximal sleeve 68. The proximal sleeve has a round tubular configuration. The proximal sleeve has a first length, with a push rod hole 70 there through. The proximal sleeve push rod hole is sized to be greater than the fourth external diameter, less than the fifth external diameter, and sized to slideably receive the proximal central push rod within the proximal sleeve push rod hole.

The proximal central push rod distal sleeve has a round tubular configuration with a second length with a push rod hole 72 therethrough. The distal sleeve push rod hole has a stepped 74 internal diameter, with the push rod hole of the proximal end of the distal sleeve being sized to slidably receive the fourth external diameter of the proximal push rod, and the push rod hole of the distal end of the distal sleeve being sized to slidably receive the fifth external diameter of the end stop flange of the distal end of the proximal central push rod.

The push rod hole of the distal end of the distal sleeve is greater than the push rod hole of the proximal end of the distal sleeve, thereby restricting the travel of the proximal push rod within the push rod hole of the distal sleeve. The second sleeve length is greater than the first sleeve length.

The distal push rod has a guide sleeve 76. The guide sleeve has a round tubular configuration with a first length, with a push rod hole 78 therethrough.

There is a beveled slide collar 80. The beveled slide collar is fabricated of a rigid material. The beveled slide collar has an exterior surface 82 and an interior surface 84, with a thickness therebetween. The beveled slide collar has a tapered central aperture 86 therethrough, with the tapered central aperture having a proximal end 88 and a distal end 90. The proximal end aperture is larger then the distal end aperture, with a continuous narrowing of the aperture therebetween.

The beveled slide collar has four locking lug holes 92 running radially from the exterior surface to the interior surface. The beveled slide collar has four locking lugs 94 with one of the locking lugs being associated with one of the locking lug holes. The locking lugs each have a solid tubular shaft configuration. The proximal end of the beveled slide collar has a recess 96 therein.

There is a beveled slide 100. The beveled slide has four like-configured components 102.

Figure 10:
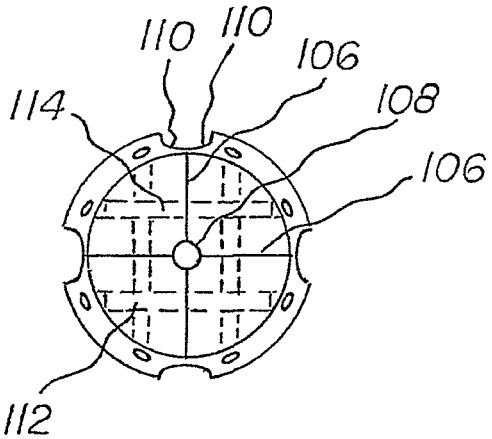
FIG. 10 is a view taken along line 10-10 of FIG. 9.
Figure 11:
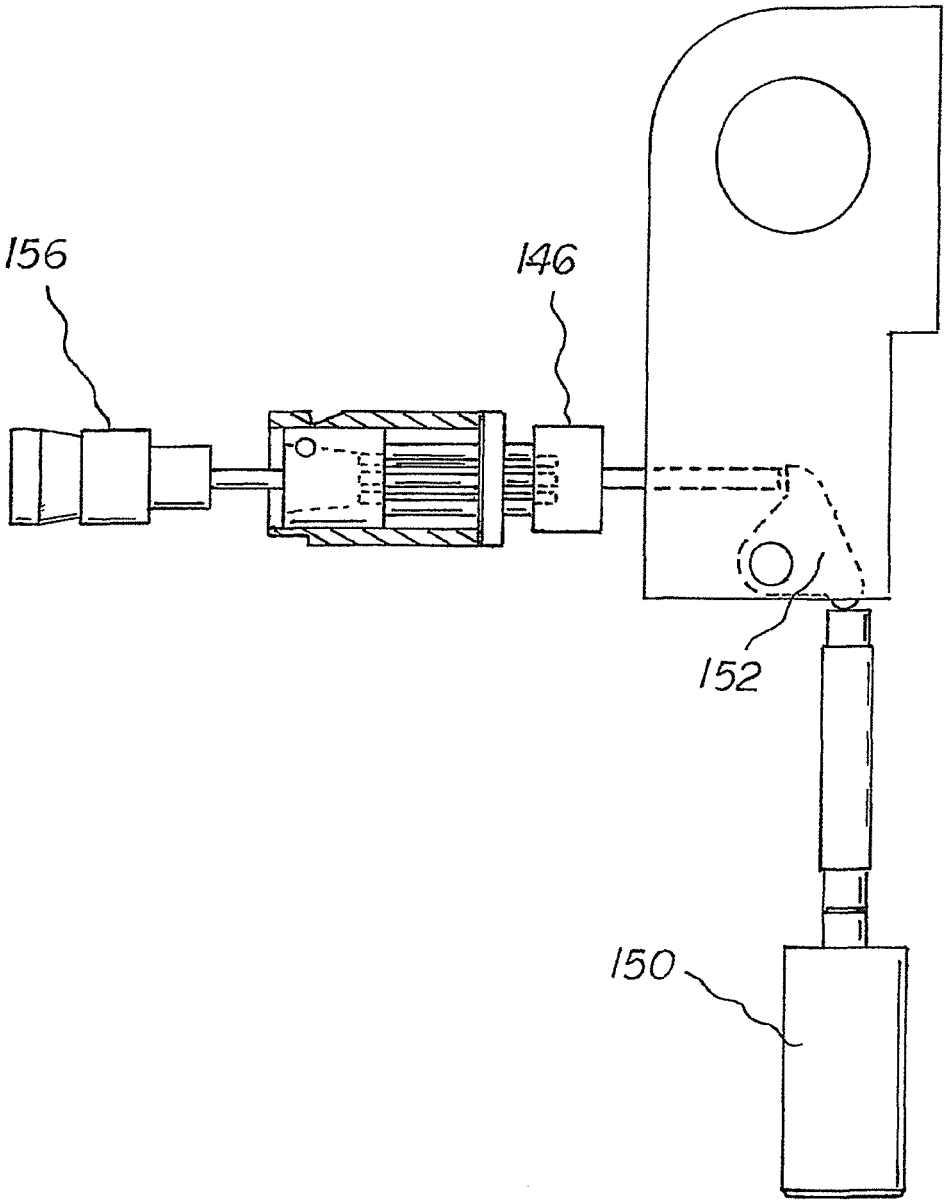
FIG. 11 is a side elevational view of the actuating device showing the push rods, segmented die, and hammer assembly as they are operationally oriented.
Figure 12:
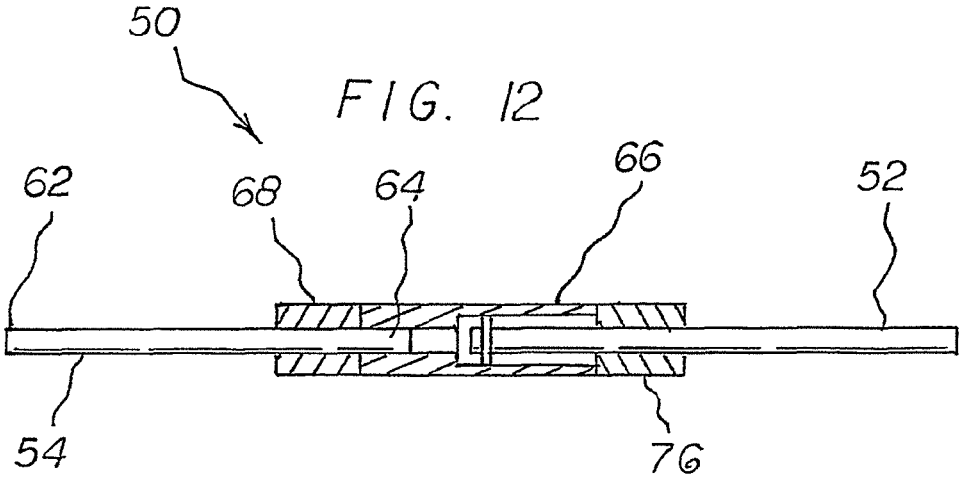
FIG. 12 is a cross sectional view of the central push rod assembly.
Figure 13:
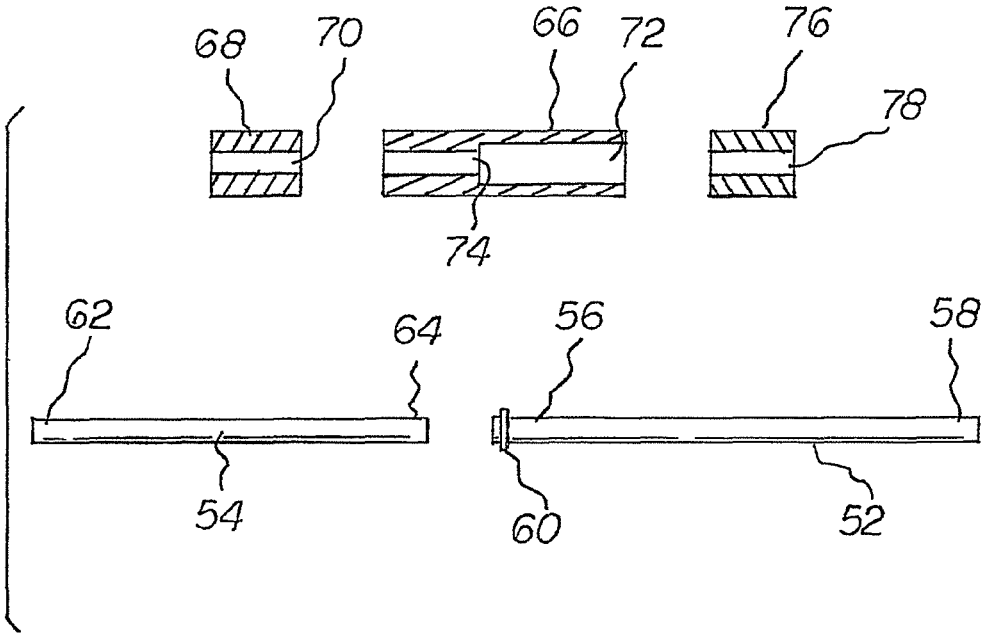
FIG. 13 is an exploded view of the central push rod assembly.
Figure 14:
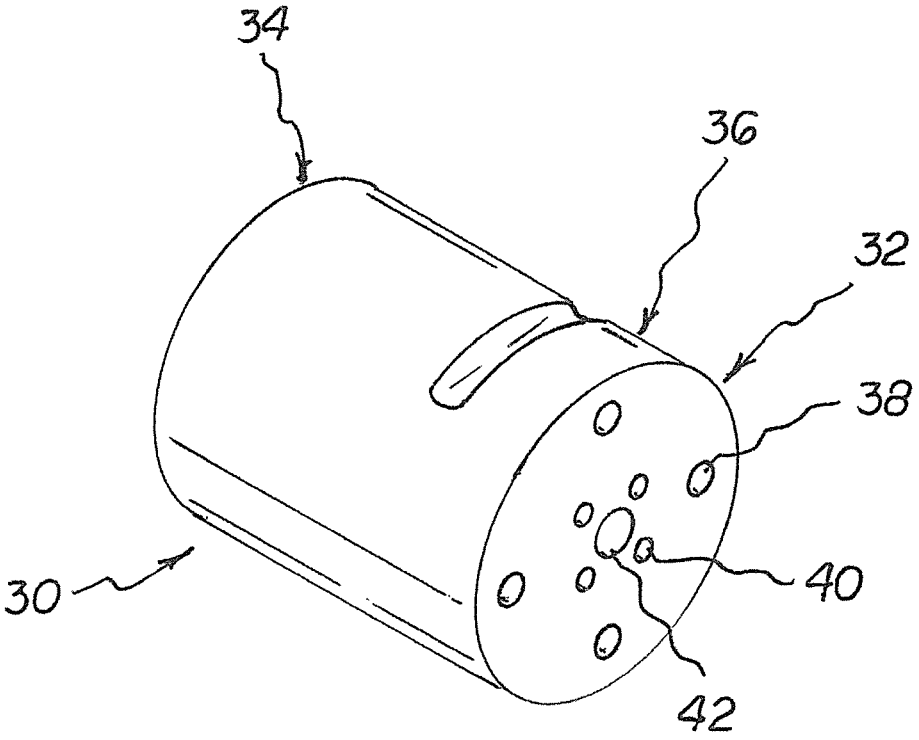
FIG. 14 is a perspective view of the internal guide.

In the preferred embodiment, each component of the beveled slide has a tapered exterior surface 104 and a perpendicular biplanar interior surface 106, with a central recess therein 108. Each beveled slide component exterior surface has a V-shaped tapered recess 110 therein. Each component has a pair of intersecting pin holes 112 running secantly from the exterior surface to the interior surface. Each of the intersecting holes has an associated pin 114. In demonstrating the direction of the pin 114 in FIG. 10, it should be noted that there are four components making up the beveled slide. In the view of FIG. 10, each component has an exterior surface with a bevel 104, as shown in FIG. 8, and two internal surfaces, which are located at right angles to each other, as shown in FIG. 10. As can be seen in FIG. 10, the pins 114 run from the external surface of each component to an internal surface of each component. When viewed with all four components in operational configuration, as shown in FIG. 10, the pin runs "secantly" through the circle which is formed by the exterior of each of the components.

The preferred embodiment of the beveled slide is described, however, the configuration of the beveled slide is job specific, and effectuates the molding process by it very configuration. It is understood that the internal configuration of a beveled slide may vary from job to job. The external configuration, being the tapered exterior surface, is critical to the operation of the system, and is not changed from job to job.

There is a push rod guide 120. The push rod guide has a round solid disc-like configuration with a central push rod hole 122, four internal push rod holes 124, four external push rod holes 126, and four recessed bolt holes 128 therein. The central push rod hole is sized to slidably receive the central push rod. The four internal push rod holes are sized to slidably receive each of the four internal push rods. The four external push rod holes are sized to slideably receive each of the four external push rods. The push rod guide has three associated threaded screws 130, with the screws being configured to be threadedly received and be mated with each of the threaded assembly screw holes of the actuating body.

There are four external push rods 132. Each external push rod has a straight solid rod configuration. Each external push rod is sized to be slidably received within the external push rod holes of the internal guide.

There are four internal push rods 134. Each internal push rod has a straight solid rod configuration. Each internal push rod is sized to be slidably received within the internal push rod holes of the internal guide.

There is an internal distal collar slide 136. The internal distal collar slide has a round shaft configuration, with a proximal end 138 and a distal end 140. The internal distal slide collar has a central aperture therethrough 142. The central aperture of the internal distal collar slide runs from the proximal end to the distal end. The internal distal slide collar proximal end has a protrusion 144.

Lastly, there is an internal distal collar slide body 146. The internal distal collar slide body has a round shaft configuration, with a proximal end and a distal end. The internal distal slide collar body has a central aperture therethrough. The central aperture of the internal distal collar slide body is sized to slidably receive the internal distal collar slide there within.

In operation, the actuating device is used for progressive cold forging of asymmetrical components. The actuating device utilizes a nitrogen gas spring 150 or equivalent, which is commonly well known in the industry. The use of the nitrogen gas spring provides for an equal and opposite force to offset the pressure from the advancing ram slide of a hammer assembly, engaging the beveled collar, which is prevented from moving backwards by the four external push rods, and closing the beveled slide components securely, prior to the forming process.

The high force potential of a nitrogen spring is approximately 4 to 15 time greater than that of a heavy coil spring. The nitrogen spring force keeps the segmented die in a closed position during the forming process, thereby preventing material flash between the beveled components, or segmented die components.

The nitrogen spring is coupled to a rocker 152, which translates the direction of force into the system herein described. The rocker lever 154 then forces the internal distal collar slide in a proximal direction, thereby pushing on the external push rods, forcing the segmented die in the proximal direction. The hammer assembly 156 then presses distally, forcing the segmented die closed, compressing the piece within the die and forming the piece.

The segmented die is piece specific, meaning that the interior of the die is specific to each molded piece. The segmented die, or beveled slide components, are coated with a lubricious CVD or PCD coating. The angle of the slide is between about 3 and 15 degrees. In the preferred embodiment, the angle of the slide is in the range of 5 to 10 degrees. The beveled slide collar has a tapered aperture which is formed within the range of a 5 degree to 10 degree taper.

All tolerances in the assembly of the device are best described as "tight" tolerances, and all references to a component being "slidably" received implies, and should be considered to be, a tight tolerance between the sliding part and the part the sliding part slides in.

To initiate the process, a partially formed piece is transferred into the central aperture of the slide components, also known as a segmented die. Once the part is within the closed segmented die, a punch pin engages the work piece and the nitrogen springs compress, while the ram slide moves the die. The work piece is held in place in the segmented die by the locking lugs.

The preferred embodiment of the segmented die has been described. However, there are a vast number of die configurations for doing an equally vast number of forming processes using a segmented die. It should be understood that the preferred embodiment of the specific die is not a limitation of the applications of this invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An actuating device comprising, in combination:

an actuating body having a proximal end and a distal end, the actuating body having a generally round tubular configuration with an exterior surface and an interior surface and a width there between, an internal guide configured to be slidably received within the interior surface of the actuating body, the internal guide having a proximal end and a distal end, the internal guide having a generally round solid configuration with an external surface, the internal guide having a centrally located central push rod hole;

a central push rod assembly located within the central push rod hole of the internal guide, a beveled slide collar having an exterior surface and an interior surface with a thickness therebetween, the beveled slide collar having a tapered central aperture therethrough, the beveled slide collar being located within the interior surface of the actuating body;

a beveled slide having four like-configured components, with each component having a tapered exterior surface and a perpendicular biplanar interior surface with a central recess therein, the beveled slide being located within the interior surface of the beveled slide collar;

at least one push rod;

the internal guide having four external push rod holes located a first distance from the central push rod hole, the four external push rod holes having a first internal diameter, with the four internal push rod holes being annularly located running from the proximal end of the internal guide to the distal end of the internal guide;

the central push rod assembly comprising a distal central push rod and a proximal central push rod, the distal central push rod and the proximal central push rod each having a fourth external diameter;

the beveled slide collar tapered central aperture having a proximal end and a distal end, the proximal end aperture being larger then the distal end aperture with a continuous narrowing of the aperture there between;

the internal guide having four internal push rod holes with the four internal push rod holes being located a second distance from the central push rod hole;

each beveled slide component exterior surface having a V-shaped tapered recess therein;

a push rod guide having a round solid disc-like configuration with a central push rod hole and four internal push rod holes and four external push rod holes and four recessed bolt holed therein, the central push rod hole being sized to slidably receive the central push rod;

the distal central push rod having a round solid straight shaft configuration with a proximal end and a distal end;

the proximal central push rod comprising a round solid straight shaft configuration with a proximal end and a distal end, the distal central push rod comprising a round solid straight shaft configuration with a proximal end and a distal end, the proximal end of the distal central push rod having an end flange, the end flange having a fifth external diameter with the fifth external diameter being greater than the fourth external diameter of the proximal central push rod;

the beveled slide collar having four locking lug holes running radially from the exterior surface to the interior surface; and each beveled slide component having a pair of intersecting pin holes running secantly from the exterior surface of the slide component to the interior surface of the slide component with each of the intersecting holes having an associated pin.

2. The actuating device as described in claim 1, with the actuating device further comprising:

the actuating body having a pair of locking pin holes there through with each locking pin hole having an associated locking pin;

the internal guide four external push rod holes being annularly located running from the proximal end of the internal guide to the distal end of the internal guide, the proximal central push rod having a distal sleeve and a proximal sleeve, the proximal sleeve having a round tubular configuration with a first length with a push rod hole there through, the distal sleeve having a round tubular configuration with a second length with a push rod hole there through with the push rod hole having a stepped internal diameter with the push rod hole of the proximal end of the distal sleeve being sized to slidably receive the fourth external diameter of the proximal push rod; and the beveled slide collar having four locking lugs with one of the locking lugs being associated one of the locking lug holes, the locking lugs having a solid tubular shaft configuration.

3. The actuating device as described in claim 2, with the actuating device further comprising:

the internal guide four external push rod holes being located a first distance from the central push rod hole, the distal central push rod having a stop flange having a fifth external diameter;

the push rod hole of the distal end of the distal sleeve of the proximal central push rod being sized to slidably receive the fifth external diameter of the end stop flange of the proximal end of the distal central push rod;

the proximal sleeve push rod hole being sized to be greater than the fourth external diameter and less than the fifth external diameter and sized to slideably receive the proximal central push rod within the proximal sleeve push rod hole;

the push rod hole of the distal end of the distal sleeve being greater than the push rod hole of the proximal end of the distal sleeve, thereby restricting the travel of the proximal push rod end stop flange within the push rod hole of the distal sleeve;

the proximal end of the beveled slide collar having a recess therein; and four external push rods with each external push rod having a straight solid rod configuration, with each external push rod being sized to be slidably received within the external push rod holes of the internal guide.

4. The actuating device as described in claim 3, with the actuating device further comprising:

the actuating body having three threaded assembly screw holes in the proximal end, the locking pin holes passing through the actuating body in a secant orientation;

the internal guide four external push rod holes having a first internal diameter, the push rod guide having three associated threaded screws with the screws being configured to be threadedly received and mated with each of the threaded assembly screw holes of the actuating body; and four internal push rods with each internal push rod having a straight solid rod configuration, with each internal push rod being sized to be slidably received within the internal push rod holes of the internal guide.

5. The actuating device as described in claim 4, with the actuating device further comprising:

the actuating body exterior surface having a pair of wedge shaped recesses located adjacent the proximal end and an inlet recess located on the proximal end;

the internal guide four internal push rod holes being annularly located running from the proximal end of the internal guide to the distal end of the internal guide; and the distal central push rod stop flange being located adjacent the proximal end of the distal central push rod, the stop flange being sized to be slidably received within the third internal diameter of the internal guide central push rod hole.

6. The actuating device as described in claim 5, with the actuating device further comprising:

the internal guide four internal push rod holes being located a second distance from the central push rod hole;

the distal push rod having a guide sleeve with the guide sleeve having a round tubular configuration with a first length, with a push rod hole therethrough; and an internal distal collar slide having a round shaft configuration with a proximal end and a distal end, the internal distal slide collar having a central aperture therethrough running from the proximal end to the distal end, the internal distal slide collar proximal end having a protrusion therein.

7. The actuating device as described in claim 6, with the actuating device further comprising:

the internal guide first distance being greater than the internal guide second distance;

the second distal sleeve length being greater than the first proximal sleeve length;

an internal distal collar slide body having a round shaft configuration with a proximal end and a distal end, the internal distal slide collar body having a central aperture therethrough, the central aperture of the internal distal collar slide body sized to slidably receive the internal distal collar slide there within; and the first push rod hole distance being greater than the second push rod hole distance.

8. The actuating device as described in claim 7, with the actuating device further comprising:

the internal guide four internal push rod holes having a second internal diameter, the first internal diameter being greater than the second internal diameter, the internal guide central push rod hole having a third internal diameter, with the third internal diameter being greater than the first internal diameter; and the four internal push rod holes having a second internal diameter, the first internal diameter being greater than the second internal diameter, the internal guide central push rod hole having a third internal diameter, with the third internal diameter being greater than the first internal diameter.

9. The actuating device as described in claim 8, with the actuating device further comprising:

the actuating device body being fabricated of a rigid material;

the internal guide being fabricated of a rigid material;

the beveled slide collar being fabricated of a rigid material; and the four internal push rod holes being sized to slidably receive each of the four internal push rods, the four external push rod holes being sized to slideably receive each of the four external push rods.

10. An actuating device comprising, in combination:

an actuating body having an interior surface;

an internal guide is slidably received within the interior surface of the actuating body, the internal guide having a centrally located central push rod hole;

a central push rod assembly located within the central push rod hole of the internal guide, the central push rod assembly having a distal central push rod and a proximal central push rod;

a beveled slide having four like-configured components, the beveled slide is contained within the actuating body; at least one push rod couples the internal guide and the beveled slide;

a beveled slide collar having a tapered central aperture therethrough, the beveled slide collar being located within the interior surface of the actuating body, the beveled slide collar containing the beveled slide within the tapered central aperture of the beveled slide collar; and the beveled slide components are each coupled together with each having pair of intersecting pin holes running secantly from an exterior surface of the slide component to an interior surface of the slide component with each of the intersecting holes having an associated pin.

11. The actuating device as described in claim 10, with the actuating device further comprising:

the central push rod assembly comprising a distal central push rod and a proximal central push rod, the distal central push rod and the proximal central push rod each having a common diameter with the proximal central push rod comprising a round solid straight shaft configuration with a proximal end and a distal end, the distal end of the proximal central push rod having an end flange, the distal central push rod having a proximal end and a distal end, with the distal end of the distal central push rod having a stop flange; and a push rod guide having a round solid disc-like configuration with a central push rod hole and four internal push rod holes and four external push rod holes and four recessed bolt holed therein, the central push rod hole being sized to slidably receive the distal end of the distal central push rod.

12. The actuating device as described in claim 11 with the actuating device further comprising an internal distal collar slide having a round shaft configuration with a proximal end and a distal end, the internal distal slide collar having a central aperture therethrough running from the proximal end to the distal end, the internal distal slide collar proximal end having a protrusion therein.

* * * * *